United States Patent [19]

Hiruma et al.

[11] Patent Number: 4,569,482

[45] Date of Patent: Feb. 11, 1986

[54] CLEANING APPARATUS AND METHOD UTILIZING PRESSURIZED WATER

[75] Inventors: Yutaka Hiruma; Akira Okita, both of Tokyo, Japan

[73] Assignee: Tokyo Road Engineering Co., Ltd., Tokyo, Japan

[21] Appl. No.: 556,244

[22] PCT Filed: Apr. 28, 1982

[86] PCT No.: PCT/JP82/00145

§ 371 Date: Nov. 9, 1983

§ 102(e) Date: Nov. 9, 1983

[87] PCT Pub. No.: WO83/03781

PCT Pub. Date: Nov. 10, 1983

[51] Int. Cl.[4] ..... B05B 1/28

[52] U.S. Cl. ..... 239/296; 239/424; 239/430; 239/601

[58] Field of Search ..... 239/290, 296, 299, 398, 239/418, 419, 423, 424, 427.3, 430, 433, 601, DIG. 1, 416.5, 291

[56] References Cited

U.S. PATENT DOCUMENTS 1,302,950 5/1919 Muckle ..... 239/427.3

2,029,337 2/1936 Parker ..... 239/424

FOREIGN PATENT DOCUMENTS 294762 4/1928 United Kingdom ..... 239/398

*Primary Examiner*—Jeffrey V. Nase

*Assistant Examiner*—James R. Moon, Jr.

*Attorney, Agent, or Firm*—Robbins & Laramie

[57] ABSTRACT

A cleaning apparatus and method is disclosed which utilizes a nozzle generally comprising a cylindrical drum having external and internal air chambers, each of which terminates in a pipe having a rectangular cross-section. One of the pipes has a smaller cross-section than the other, and is disposed within the larger pipe. A high-pressure water pipe is concentrically disposed along the longitudinal axis of the smaller pipe. The space between the two pipes defines a passageway for a stream of compressed air which shapes the stream of water emanating out of the center of the smaller pipe into a jet of water having a bar-shaped cross-section, and a uniform pressure gradient at all points across this cross-section. The smaller pipe is provided with a symmetrical array of apertures for shunting part of the air stream flowing between the two pipes in a radial direction toward the pressurized stream.

5 Claims, 8 Drawing Figures

CLEANING APPARATUS AND METHOD UTILIZING PRESSURIZED WATER

BACKGROUND OF THE INVENTION

The present invention relates to an apparatus and method of using high-pressure water to effectively wash facilities on an industrial field, such as for example, the walls of tunnels under construction at road sites. The invention makes use of a vehicle-mounted water sprayer capable of discharging pressurized water in a uniform, bar-shaped pattern.

The water sprayer of the invention ejects a bar-shaped water jet formed from uniformly pressurized streams of atomized water. The bar-shaped jet is formed by impinging a high-pressure stream of water with compressed air discharging through the walls of a rectangular nozzle and further impinging said jet with other air flow by means of other instruments mounted on the moving vehicle.

Most conventional nozzles eject either elliptical, circular, or ring-type patterns of liquid depending upon the shape and size of the discharge port of the nozzle. Such an elliptical pattern is shown in FIG. 5. Here, the maximum pressure is located at the center portion thereof and becomes pregressively lower at the peripheral portion of the ellipse, the further one gets from the axis O. The resulting variable pressure gradient is shown in FIG. 7. Such a gradient is present even in those nozzles where the angle of the nozzle port is constructed to be variable. The resulting pressure distribution pattern may be simply represented as a series of isobaric electrical lines which resemble hills in a map (FIG. 8). Such a representation clearly demonstrates that a uniformless pressure is apt to occur particular in the direction of the Y axis of the ejection stream. Such non-uniformity compels the operator to either excessively repeat the movement of the nozzle over the structure being cleaned in order to obtain the desired washing effect, or to use a plurality of nozzles.

SUMMARY OF THE INVENTION

The present invention relates to an apparatus and method of washing road facilities, and generally comprises a cylindrical drum havig an external and internal air chamber, each of which terminates in a pipe having a rectangular cross-section. One of the pipes has a smaller cross-section than the other, and is disposed within the larger pipe. A high-pressure water pipe is concentrically disposed along the longitudinal axis of the smaller pipe. The space between the two pipes defines a passageway for a stream of compressed air which shapes the stream of water emanating out of the center of the smaller pipe into a jet of water having a bar-shaped cross-section and a uniform pressure gradient at all points across this cross-section. Preferably, the velocity of the stream of compressed air is approximately equivalent to the velocity of the water jet leaving the water pipe. Additionally, the smaller pipe is provided with a symmetrical array of apertures for shunting part of the air stream flowing between the two pipes in a radial direction toward the pressurized stream.

BRIEF DESCRIPTION OF THE SEVERAL FIGURES

DETAILED DESCRIPTION OF THE PREFERRED EMBODIMENT

Figure 6:
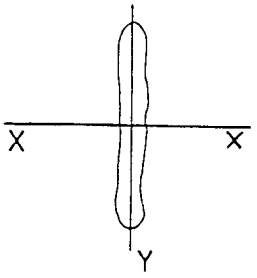
FIG. 6 is a graph representing the water pressure distribution pattern of FIG. 4, and FIGS. 7 and 8 show conventional water distribution patterns, respectively.
Figure 8:
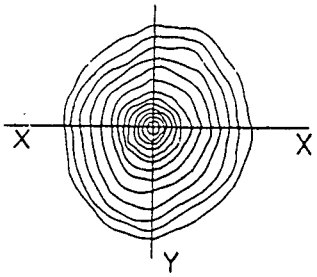

The present invention encompasses both a method of ejecting high-pressure water, as well as a nozzle for carrying out the method. The invention is particularly useful, when mounted on a traveling vehicle, for washing the wall surface of a tunnel. The nozzle of the invention achieves a superior washing action by means of a jet of water having a bar-shaped cross-section as shown in FIG. 6, which exerts a uniform pressure on both the X and Y axes of the nozzle.

Figure 1:
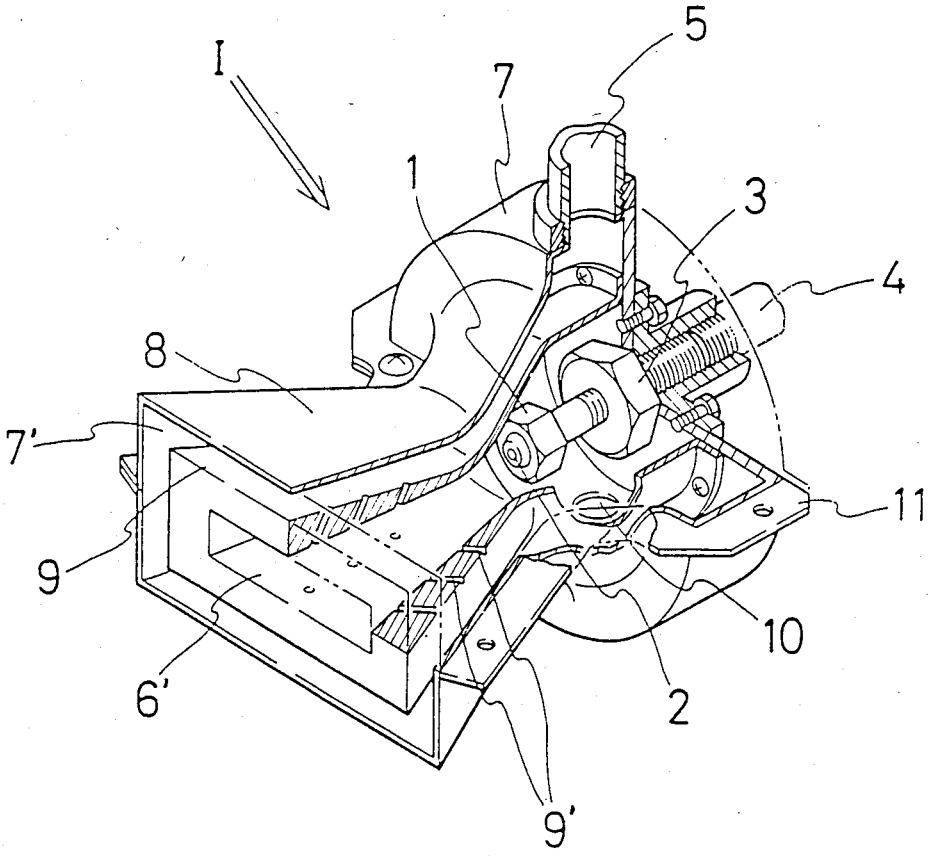
FIG. 1 is a perspective view of a nozzle assembly embodying the present invention.
Figure 2:
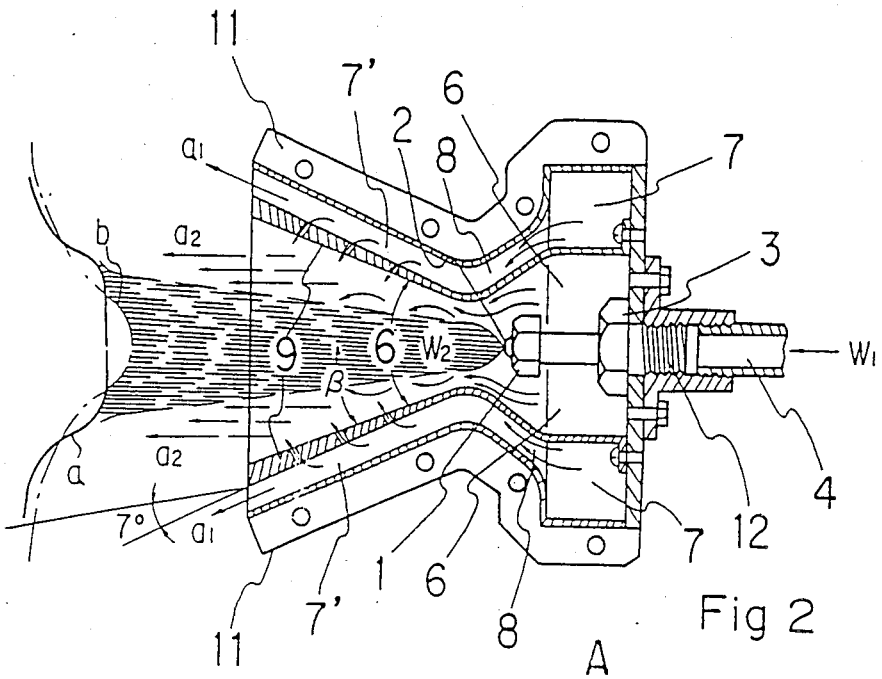
FIG. 2 is a top sectional view of this nozzle in operation.

With reference now to FIGS. 1 and 2, the nozzle "I" of the invention is provided with a first pipe 8 having a hollow rectangular section extending therefrom and a second pipe 9 having a smaller rectangular section arranged within the rectangular section of the first pipe 8. A high-pressure water pipe 4 which terminates in a tip 1 having a water port 2 is centrally arranged within the rectangular section of the second pipe 9. Water port 2 is preferably elliptical in shape and less than 1 mm in diameter. Each of the pipes 8 and 9 are formed with an air flow passage 5 and 10 which communicates with a source of pressurized air A to create a double layer of compressed air around the stream of water emanating from the water port 1. The nozzle "I" further includes a cylindrical drum disposed at the back side thereof which is formed in part by the rear walls of both pipes 8 and 9. The drum includes a first, annularly shaped air chamber 7 formed around the periphery of the drum, and a second circularly shaped air chamber 6 circumscribed by the first chamber 7. The previously mentioned air port 10 places the two chambers 6 and 7 into fluid communication, so that some of the compressed air entering the first chamber 7 via pipe 5 ultimately enters the chamber 6. A base 3 formed from a nut and threaded nipple arrangement supports the tip 1 of the high-pressure water pipe 4 which extends through the back of the drum of the nozzle and inside the second pipe 9.

Figure 3:
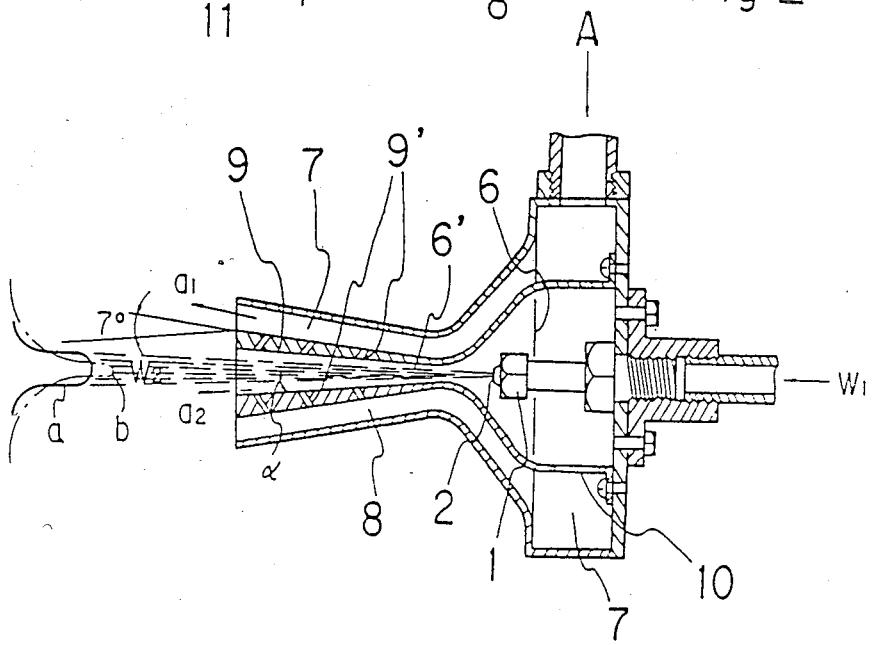
FIG. 3 is a side sectional view of this nozzle in operation.

With specific reference to FIGS. 2 and 3, the angle $\beta$ shown in the top view of the nozzle "I" is preferably about 12.5° from the center line of the nozzle "I" to the inner surface of the smaller pipe 9, while the ejection angle $\alpha$ is approximately 2° from the center line. The stream of air $a_1$ flowing through the passage 7′ defined between the larger pipe 8 and the smaller pipe 9 diverges at least 7° from the plane defined by the outer surface of the smaller pipe 9 and squeezes the jet of water $W_2$ emanating from the tip 1 of the pipe 4. Preferably, the nozzle "I" is 65 mm by 15 mm at its rectangular end, and 90 mm in depth according to the embodiment, and assembled by means of flanges 11 and 11′ on both sides.

Figure 4:
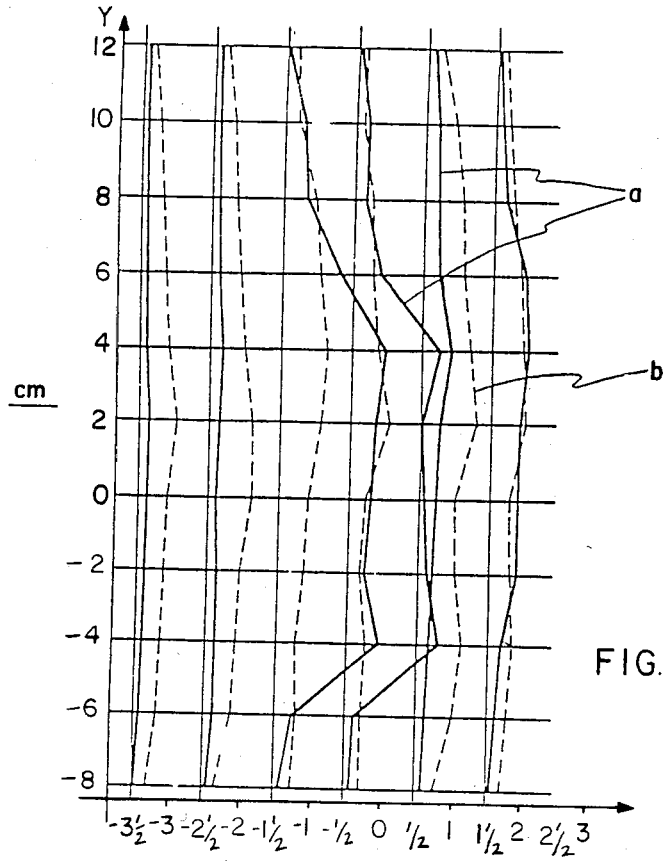
FIG. 4 is a graph illustrating the pressure distribution of the jet produced by the nozzle of the invention.
Figure 5:
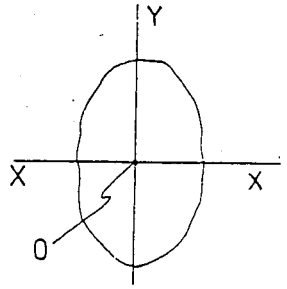
FIG. 5 shows a conventional water distribtution pattern.
Figure 7:
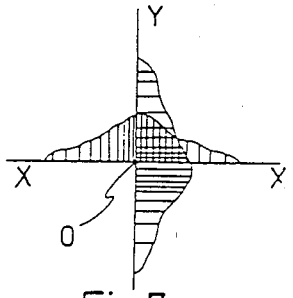

The nozzle "I" of the invention is operated in conjunction with an engine, a high-pressure pump and an air compressor (respectively not illustrated) loaded on a vehicle. Water $W_1$ at a pressure of 500 kg/cm$^2$ is fed to the charging pipe 4 and out of the water port 2. Thus, a water flow $W_2$ is ejected frontward out of the elliptical port 2 as indicated by the dashed lines. Simultaneously therewith, the greater portion $a_1$ of the compressed air flow A out of the charging pipe 5 is discharged into the passage 7' from said first air chamber 7 of the drum at a speed which results in a flow rate of between 5 kg/cm$^2$ and 8 kg/cm$^2$, which makes its speed approximately equivalent to the speed of the ejected water flow 2. However, some of this compressed air flows through air port 10 into the chamber 6 and around the water flow $W_2$ in order to equalize the low pressure region created within the chamber 6 by the flow of pressurized water $W_2$. This low pressure region further shunts some of the air flow $a_1$ of said passage 7' into the inside passage 6' through air passage holes 9',9' which slope downwardly through the wall of the pipe 9. Accordingly, the particles forming the flow $W_2$ are collimated all the more in the direction of the vertical axis Y of the passage 6'. The interaction of air flows $a_1$ and $a_2$ and the air flow through the holes 9' create a bar-shaped spray pattern which has a remarkably uniform pressure gradient across its X and Y axes. This uniform pressure grading is indicated by the solid lines in FIG. 4, which contrast favorably with the dotted lines which indicate the pressure gradients found in the water jets generated by prior art nozzles. The curve of a illustrated in FIG. 4 was attained by measuring the pressure distribution pattern on the surface of an object to be washed with respect to the above-mentioned function. Irrespective of changes in the operational distance, the curve of a on the surface was logically long in the shape of a bar in the direction of the Y axis, and narrow in the direction of the X axis. It is clear that the curves shown in FIG. 4 are equivalent to the flat pressure distribution curves a shown in the left sides of FIGS. 2 and 3.

An ejection water flow may produce the above-mentioned pressure pattern a according to the method of the present invention, improving the stability thereof. Moreover, the particles forming the water flow do not naturally diffuse an atomization, and accordingly, much dissipation of the energy is prevented.

It is to be understood that the action and effect in the present invention will not be limited to the embodiment mentioned above.

As a result of various experiments including applications in other fields such as a painting works, it has been found that the ejection water flow $W_2$ may be controlled and adjusted quantitatively by the relationship between the number of holes forming the air passages 9',9' and the diameters thereof or the perforated angle thereof, or by adjusting the opening angle of the air passages when the pressure of the water is selected in all particulars as desired within a range from between 100 kg/cm$^2$ and 1,000 kg/cm$^2$.

We claim:

1. A nozzle for ejecting a jet of pressurized liquid having a substantially uniform pressure gradient across its cross-section, comprising:

(a) a first conduit and a second conduit which is concentrically disposed within the first, whereby both conduits include an open end for forming and directing said jet, and a closed end for forming a first gas chamber which communicates with the space between two concentrically arranged conduits, and a second gas chamber which communicates with the interior of the second conduit;

(b) a liquid conduit for discharging a stream of pressurized liquid through the second conduit toward its open end;

(c) a compressed gas conduit fluidly connected to both said first and second gas chambers for providing streams of gas both through the space between said conduits and through the interior of said second conduit which impinge with and shape said stream of pressurized liquid, and (d) at least one aperture in the wall of said second conduit for conducting part of the stream of gas flowing through the space between said conduits into the second conduit in order to shape said stream of pressurized liquid into said jet having a uniform pressure gradient across its cross-section.

2. The nozzle of claim 1, wherein said first and second conduits are pipes having rectangular cross-sections at their open ends, and circular cross-sections at their closed ends, whereby the resulting jet of liquid has a substantially bar-shaped cross section.

3. The nozzle of claim 1, werein said second conduit includes a plurality of holes for forming a substantially symmetrical array of gas streams around the stream of pressurized liquid.

4. The nozzle of claim 3, wherein the speed of the gas flowing through said space and through the interior of the second conduit is selected so that it substantially matches the speed of the stream of liquid.

5. The nozzle of claim 2, wherein said stream of pressurized liquid is substantially aligned with the longitudinal axis of the second conduit.

* * * * *